US005171119A

United States Patent [19]

Carson

[11] Patent Number: 5,171,119

[45] Date of Patent: Dec. 15, 1992

[54] CONTAINER AND PICKUP ASSEMBLY FOR COLLECTION OF RECYCLABLE MATERIALS

[76] Inventor: William S. Carson, 3524 Twisted Oak Ct., Lake Wales, Fla. 33853

[21] Appl. No.: 723,896

[22] Filed: Jul. 1, 1991

[51] Int. Cl.[5] ..... B65B 21/02

[52] U.S. Cl. ..... 414/408; 414/411; 220/909

[58] Field of Search ..... 414/406, 408, 409, 411, 414/419, 420, 421, 541, 542, 544, 546, 549, 555; 220/909, 324, 553

[56] References Cited

U.S. PATENT DOCUMENTS

| | | | |
|---|---|---|---|
| 3,687,317 | 8/1972 | Gagel | 414/411 |
| 4,182,530 | 1/1980 | Hodge | 414/411 X |
| 4,363,588 | 12/1982 | Stickney | 414/408 |
| 4,645,018 | 2/1987 | Garbade et al. | 414/21 X |
| 4,697,836 | 10/1987 | Dutkanych | 414/407 X |
| 4,863,053 | 9/1989 | Oberg | 414/407 X |
| 5,004,392 | 4/1991 | Naab | 414/21 |
| 5,015,142 | 5/1991 | Carson | 414/408 |
| 5,015,143 | 5/1991 | Carson | 414/411 |
| 5,018,929 | 5/1991 | Carson | 414/411 X |
| 5,090,753 | 2/1992 | Goodman | 414/411 X |
| 5,114,297 | 5/1992 | Kirchhoff | 414/409 X |

FOREIGN PATENT DOCUMENTS

| | | | |
|---|---|---|---|
| 354256 | 2/1990 | European Pat. Off. | 414/408 |
| 3703557 | 8/1988 | Fed. Rep. of Germany | 414/408 |
| 1248902 | 8/1986 | U.S.S.R. | 414/407 |
| 2222813 | 3/1990 | United Kingdom | 414/408 |

*Primary Examiner*—David A. Bucci
*Assistant Examiner*—Robert S. Katz
*Attorney, Agent, or Firm*—Macdonald J. Wiggins

[57] ABSTRACT

Apparatus for receiving separated materials for selective collection of the materials includes a container divided into a plurality of bins, each bin for receiving one type of separated material, and lids for closing each of the bins. A lifting channel assembly is attached to the container, and a pickup arm assembly is provided for engaging said lifting channel preparatory to picking up said container.

7 Claims, 5 Drawing Sheets

CONTAINER AND PICKUP ASSEMBLY FOR COLLECTION OF RECYCLABLE MATERIALS

BACKGROUND OF THE INVENTION

1. Field of the Invention

The present invention relates to refuse recycling separation and collection systems for garbage, trash, and the like, and more particularly to a container adapted for mechanical picking up and dumping of separated materials.

2. Brief Description of the Prior Art

In the past few years, a number of trash pickup trucks and containers have been developed which permit pickup of trash by a trash truck operated by one person. For example, in my U.S. Pat. Nos. 4,175,903 and 5,015,143, I disclose such apparatus and containers especially designed to facilitate the lifting of the container and the dumping of its contents. Similar apparatus has been disclosed in the following U.S. Pat. No. 2,933,210; No. 4,726,726; No. 4,543,028; No. 4,722,658; and No. 4,669,940. In my U.S. Pat. Nos. 5,015,142, 5,015,143, and 5,018,929, I disclose elements of an automated system for collection of separated materials. In recent years, many communities have begun to require separation of garbage and trash into several groups, for example, cans, bottles, and paper. Such materials are required to be carried to curbside in separate containers and manually dumped into trash trucks having separate compartments for each type of separated material. The purpose is to be able to reclaim a large portion of such materials to thus minimize the trash disposal problem as well as to conserve national resources. To comply with these requirements, truck manufacturers have provided multiple compartment trucks. However, each separate container must be picked up and dumped by hand into the appropriate section of the truck.

Prior to my inventions, there was no known systems in which the collection and dumping of the materials from a divided container into separate compartments on the truck could be accomplished mechanically. Prior known collection systems have required two or more persons to expedite pickup. The present invention is a container for separated trash in combination with a pickup arm assembly which will reduce the labor and costs of separating and collecting materials for convenience and encouragement of recycling.

SUMMARY OF THE INVENTION

An outdoor container is provided, having three bins, that can be mechanically picked up by a compartmented truck having mechanized pickup capability. The contents of the outdoor container may then be selectivity deposited in the truck compartments. The outdoor container is a rectangular cart-like device preferably having a tubular framework. A handle is provided at one end and a set of wheels is provided to permit easy movement. A stand is attached at a forward end to maintain the container essentially level. The tubular framework is lined with sheet metal or plastic and divided, for example, into three bins, one for each of the recyclable materials. A sheet metal or plastic cover is provided for each bin. Each cover is hinged along one edge of its bin, and is maintained closed by its weight, or, alternatively, by a latch. The lids are easily opened by a user.

The end of the framework opposite the handle may include an identification plate attached to the upper lateral tubular member thereof which includes indicia indicative of the contents of each of the bins of the container. For example, the plate may be labeled "paper", "cans", "glass", or the initials thereof from left to right indicating the material to be deposited in each bin.

Similarly, a label may be placed on each lid indicating the contents. In addition to such indicia, in one aspect of my invention, I utilize a bar code for each bin marked on the identification plate, which may also be used to identify the customer for collection programs in which collections are charged for by weight.

Another element of the assembly of my invention is a pickup arm assembly having a pair of horizontally extending pickup arms attached to a framework. A lifting channel is attached to each side of the container for receiving the pair of pickup arms.

The pickup arm assembly is attached to and positioned by a suitable mechanism operated from a compartmented collection truck, such as disclosed in my U.S. Pat. No. 5,018,929. To pick up the outside container, the arms are extended along the longitudinal sides of the outside container so as to engage the lifting channels, and to lock the arms in the channel. A bar code reader may be attached to the clamping arm assembly in a position to contact and read the identification plate on the front of the outside container. In such instance, the pickup arms are extended to the point that the bar code reader may contact the identification plate.

In a first embodiment of the invention, the container lids each include a latch that is released by a trip assembly mounted on at least one of the pickup arms. In an alternative embodiment of the invention, hydraulically actuated lid closure elements, mounted on the pickup arm assembly, contact and hold each outside container lid closed during the lifting of the container. These closure elements are then used to selectively dump each bin of the container.

It is therefore a principal object of my invention to provide an outdoor container having a plurality of bins, and which is formed to be picked up mechanically.

It is still another object of the invention to provide a pair of pickup arms for engaging the outdoor container preparatory to picking up and selective dumping of the separated trash.

It is yet another object of the invention to provide an outdoor container having a plurality of bins for receiving separated, recyclable trash having lids held closed, and release devices on the lifting arms for selectively releasing the lids for dumping of the contents.

These and other objects and advantages of my invention will become apparent from the following detailed description when read in conjunction with the drawings.

DETAILED DISCLOSURE OF THE PREFERRED EMBODIMENT

Figure 1:
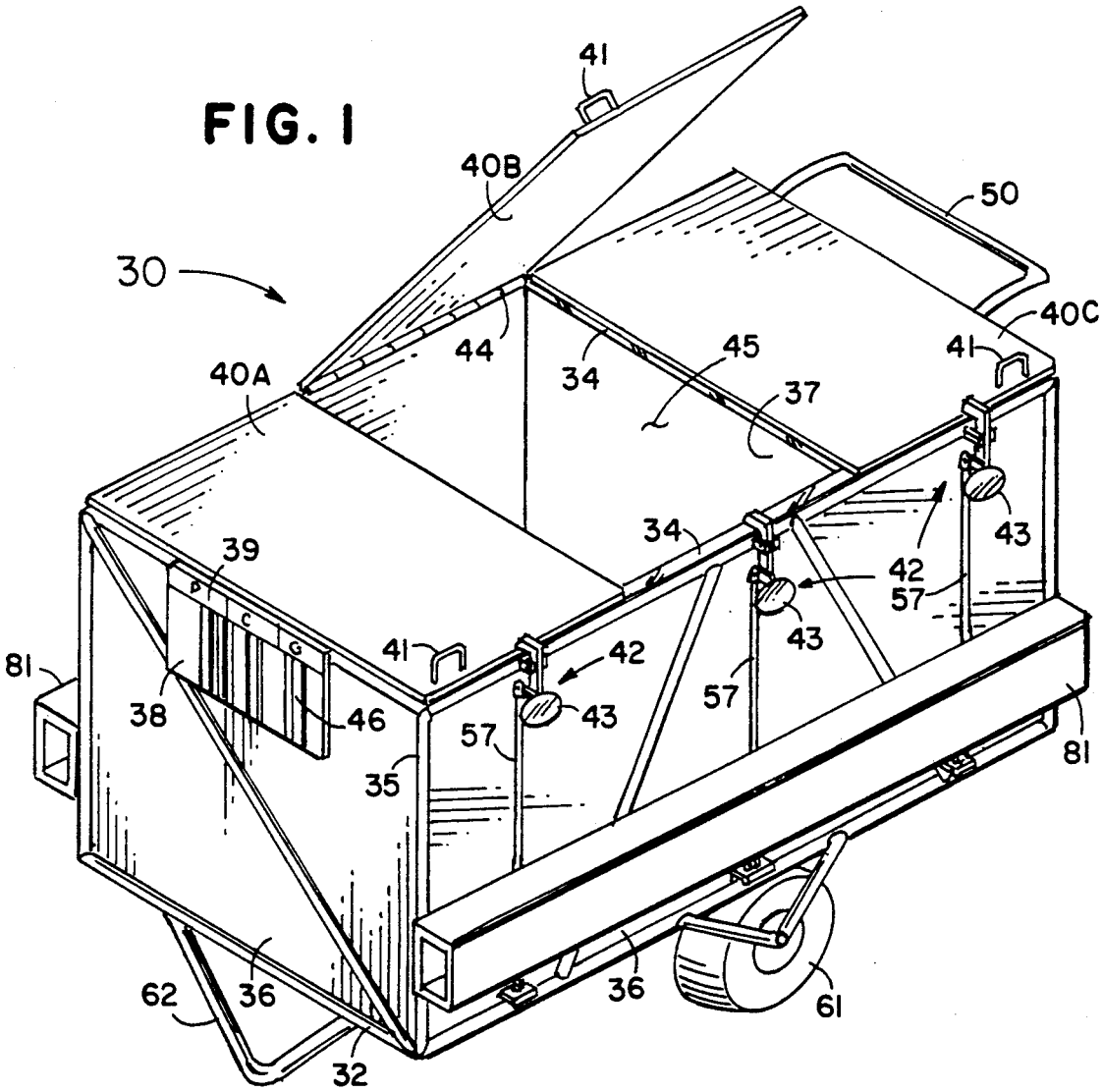
FIG. 1 is a perspective view of a first embodiment of the trash collection container assembly for use outside of a building and at curbside.

FIG. 1 illustrates a container to be normally stationed outside of a building and adapted to be moved to curbside for trash pickup. Outside container 30 preferably utilizes a tubular metal framework 32 having essentially rectangular sides. Framework 32 is covered on the inner faces thereof by panels 36 which may be of sheet metal, or sheet plastic. Alternatively, the entire container 30 may be molded from plastic. A plurality of dividers 37 is provided to divide the container 30 into a plurality of bins 45. Three bins 45 are shown although it is to be understood that the system of the invention may utilize more or less than three bins; see for example, FIG. 2. Each bin 45 includes a hinged lid 40; for example, lid 40B shown in an open position. Each lid 40 is hinged along one edge by hinge 44. Handles 41 are provided for manual opening of lid 40. Although I have shown lids 40 hinged along a longitudinal edge of container 30, the lids may be hinged laterally. A metal channel 34 may be attached around the top periphery of tubular framework 32 and divider 37 to provide a flat mating surface for lids 40.

Figure 6:
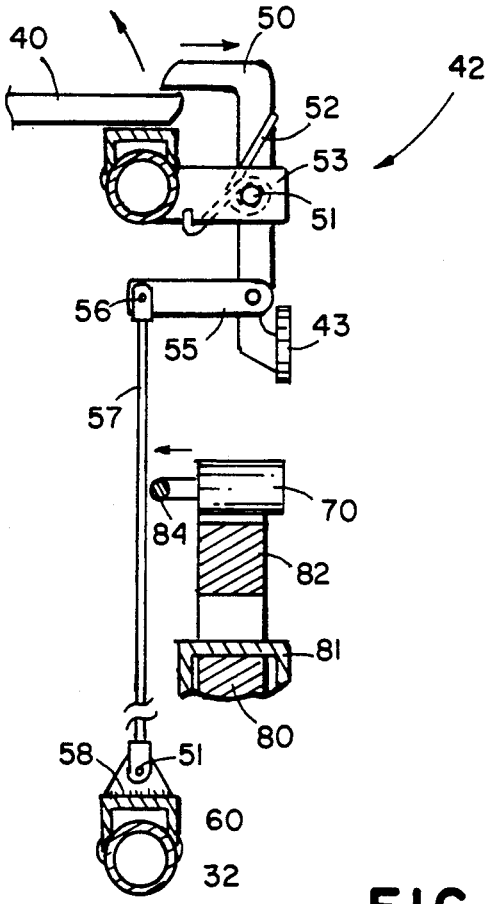
FIG. 6 shows a partial cross-sectional view of the framework of the container assembly of FIG. 2 and an end view of a pickup arm and lifting channel of FIG. 3 showing a lid release mechanism for the containers of FIG. 1 and FIG. 2.

It is necessary for lids 40 to be maintained in the closed position during a pickup and dumping procedure. To this end, a spring loaded catch 42 is provided for each bin 45, shown in more detail in FIG. 6. An operating rod 57 for each lock extends from catch 42 to a pivot bracket 60 attached to a lower element of pipe frame 32. A push plate 43 is attached to each catch 42 to permit manual release thereof for depositing materials in a bin. Pressure on push plate 43 causes catch member 50 to pivot at pin 51 in bracket 53 against spring 52, releasing lid 40. As discussed below, catch 42 may also be released by pressure against rod 57.

A lifting channel 81 is attached longitudinally along each side of container assembly 30, used for lifting the container as described hereinbelow.

To permit outside container 30 to be easily moved, a pair of wheels 61 is mounted midway of container 30 with a stand 62 at one end to maintain container 30 level when parked. A handle 50 is provided at the other end for moving container 30. The size of container 30, as well as the individual bins 45, may be selected in accordance with the expected volume of trash, frequency of collection, and relative amounts of separated trash. If the weight and size permits, casters may be substituted for stand 62 for ease of handling of outside container 30.

Figure 2:
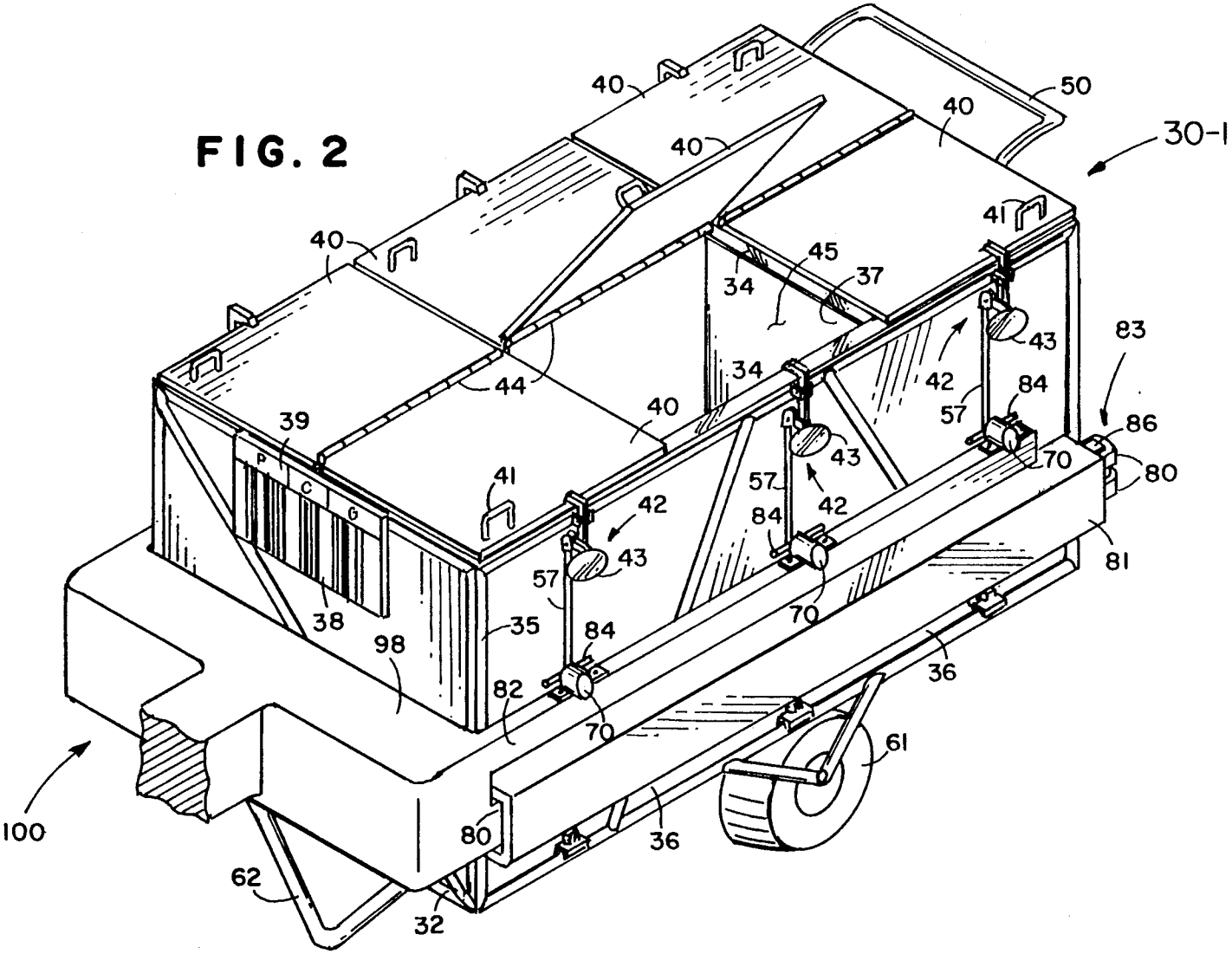
FIG. 2 is a perspective view of a container assembly of the type shown in FIG. 1 engaged by a pickup arm assembly and having six bins.

Turning now to FIG. 2, a bin 30-1 in accordance with the invention is shown. The outside container 30-1 is shown in conjunction with a pickup arm assembly 100, also seen in FIGS. 3, 4, 5 and 7. Pickup arm assembly 100 has a pair of container lifting arms 80 that are inserted by a lifting-dumping mechanism into lifting channels 81.

Outside container 30 may include a bin identification plate 38 attached to one end thereof as shown in FIGS. 1 and 2. The arrangement and contents of each bin may be indicated as at indicia 39 by appropriate legends. Additionally, a set of bar codes 46 may be provided on plate 38 for identifying the bin contents, and may also provide identification of the customer. Lifting arm assembly 100 in FIG. 5 has a barcode reader mounted thereon that may scan barcode 46 of FIG. 1 when the invention is used in an integrated lifting and dumping system.

Figure 3:
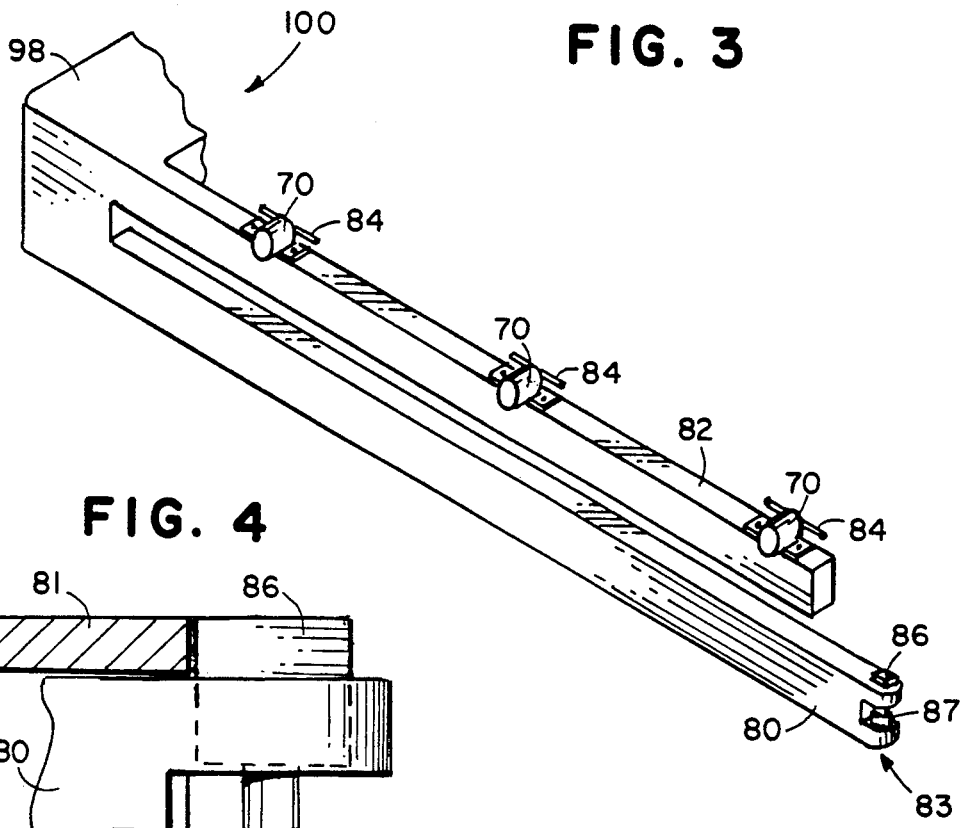
FIG. 3 is a partial perspective view of a pickup arm assembly of my invention for use with the outside container assembly of FIG. 1 and showing more detail thereof.
Figure 4:
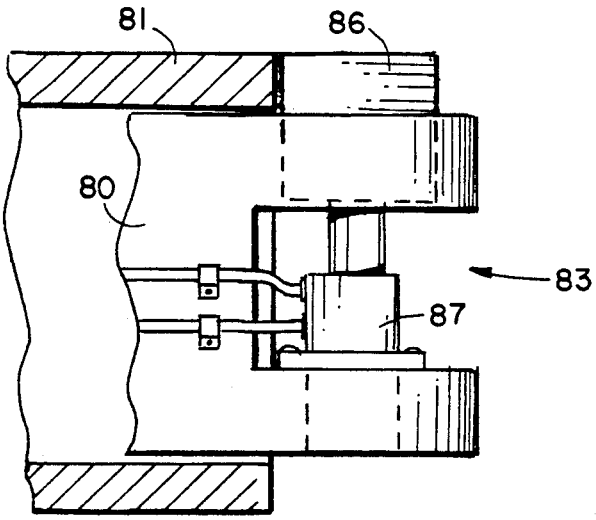
FIG. 4 shows the distal end of a pickup arm with the lifting channel shown in cross section, and a locking device for locking the arm in the channel.
Figure 5:
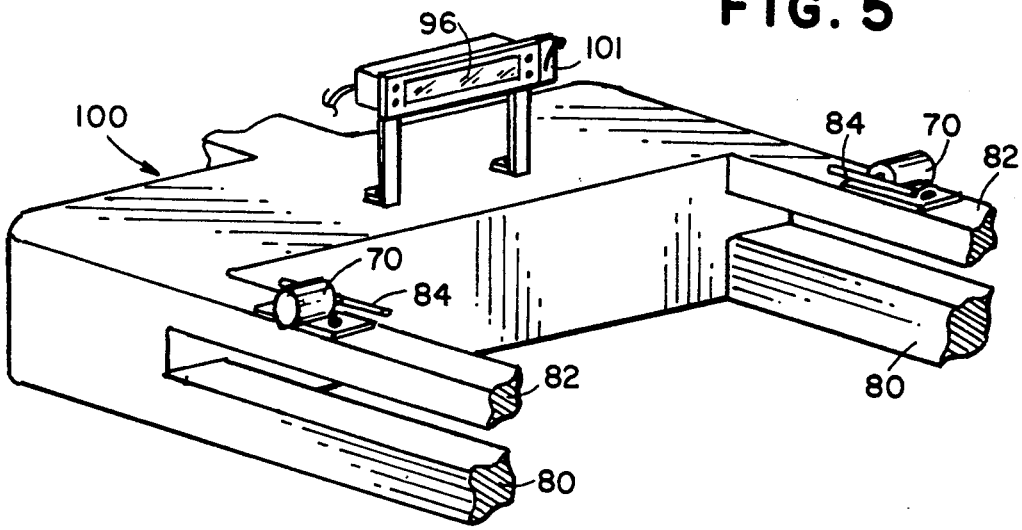
FIG. 5 is a partial view of a pickup arm of the assembly of FIG. 2 showing a bar code reader mounted thereon.

With reference to FIGS. 3 and 4, the distal end of each lifting arm 80 includes a locking device 83 utilizing a hydraulic actuator 87 and a lock bar 86. FIG. 4 shows the distal end arm 80 fully inserted into channel 81 (shown in cross section) with lock bar 86 extended. During engagement of lifting arms 80, actuator 87 and lock bar 86 is retracted. When lifting arms are fully engaged in lifting channels 80, actuator 87 is operated, extending lock bar 86 which engages channel 81.

Lifting arm assembly 100 includes a pair of lid release arms 82, extending parallel with arms 80. Release arms 82 have a plurality of hydraulic actuators 70 mounted thereon. Each actuator 70 includes a release bar 84 that contacts and applies pressure on release rod when actuator 70 is extended, releasing catch 42 as previously described. See FIG. 6.

Figure 7:
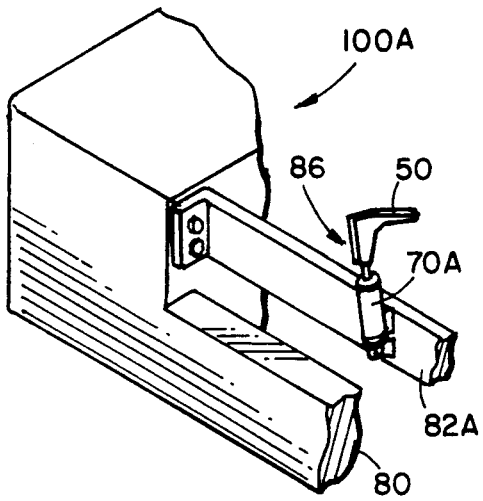
FIG. 7 shows a partial view of an alternative container lid hold-down and release device mounted to a pickup arm.
Figure 8:
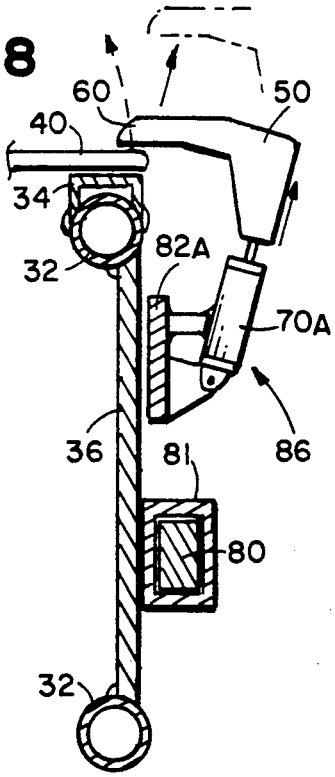
FIG. 8 is a cross sectional view of a container assembly having a hinged lid showing operation the of the alternative hold-down and release device of FIG. 7.

An alternative lid design for a container in accordance with the invention includes hinged lids without locking devices, wherein a user need only to lift a lid to deposit material. In this design, lifting arm 100A, shown in partial view in FIG. 7, is modified to support lid hold-down and release devices 86 for container lids 40-1. A bar 82A is attached to the modified lifting arm 100A. A plurality of devices 86 is mounted along bar 82A that operate as shown in FIG. 8. A linear hydraulic actuator 70A is mounted to bar 82A and operates a hold down 50 that is extended to position 50A during insertion of arms 80 into channels 81, as indicated by the arrows. After arms 80 are fully inserted, actuator 70A retracts to hold lid 40-1 closed during lifting and dumping, and is operated selectively to release lid 40-1 when dumping is required.

Figure 9:
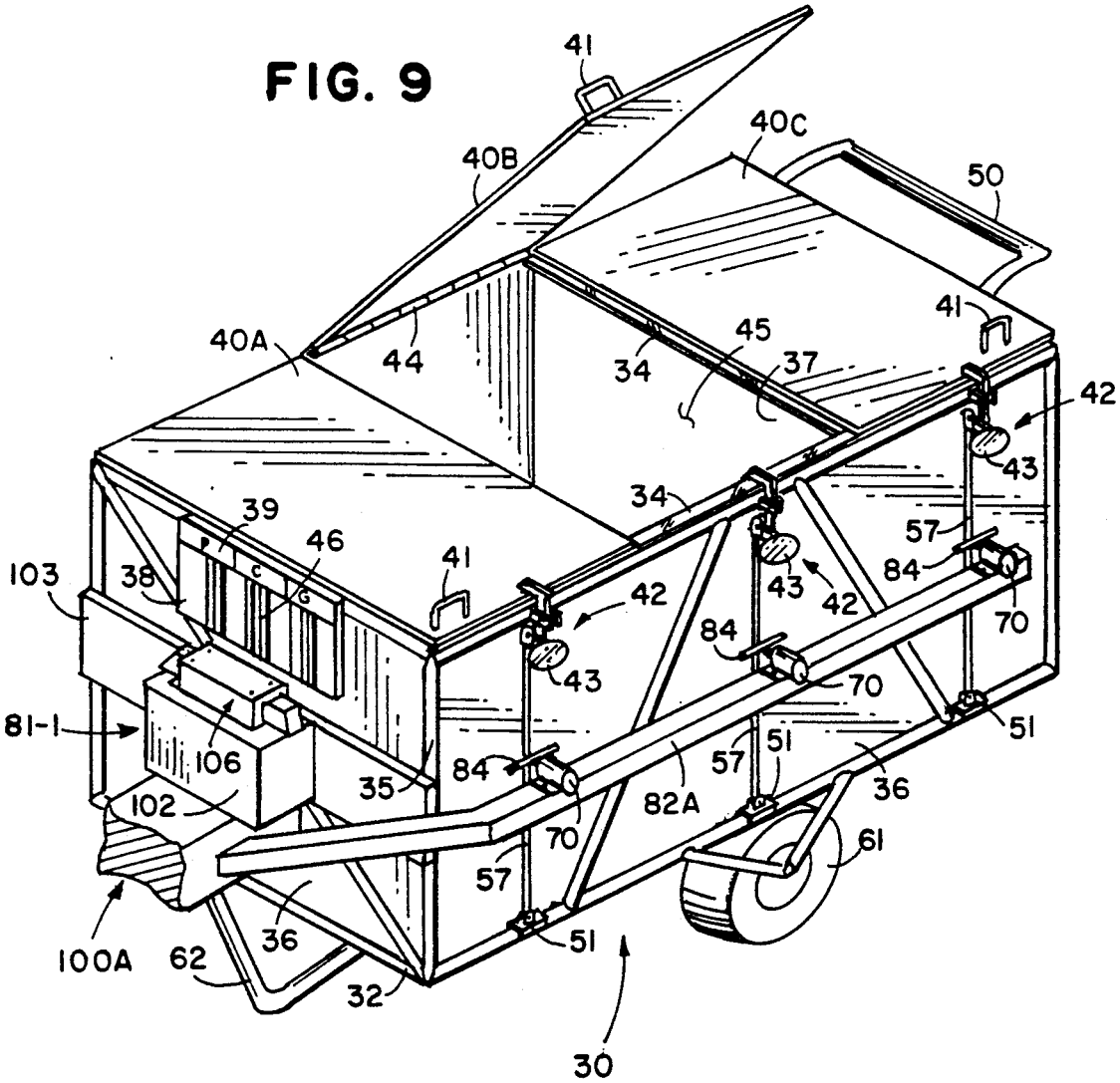
FIG. 9 is a perspective view of a second embodiment of the trash container assembly having a vertically oriented lifting arm assembly.

Referring now to FIG. 9, an alternative lifting arm assembly is shown. Container 30 includes a lifting channel 81-1 attached to the front end thereof. Channel 81-1 includes mounting plate 103, and vertical channel 102. A pickup arm assembly includes lifting arm 100A having a vertical oriented portion that is shown engaged with vertical channel portion 102. Locking device 106 at the distal end of the vertical portion of lifting arm 100A.

Lid release means is provided using a mounting bar 82A attached to mounting plate 103. Hydraulic actuators 70 having a release bar 84 are mounted to bar 82A adjacent lid release rods 57. Actuators 70 operate as previously described to selectively release lids 40 during dumping of container 30.

Figure 10:
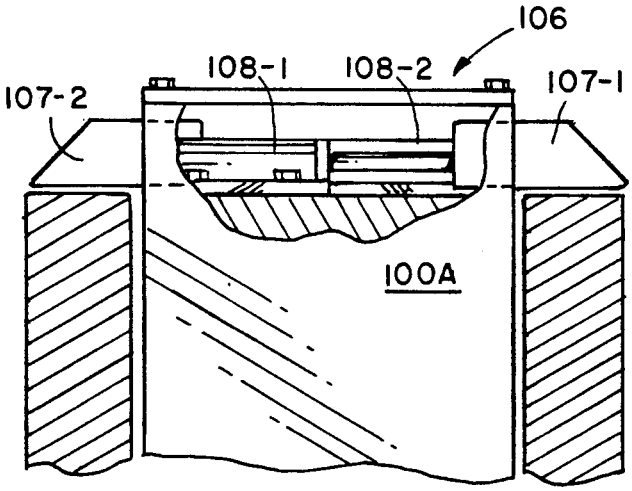
FIG. 10 shows the distal end of the lifting arm with the lifting channel shown in cross section, and a locking device for locking the arm in the channel.

The operation of locking device 106 is shown in FIG. 10. A pair of hydraulic actuators 108-1 and 108-2 are mounted to the end of the vertical portion of lifting arm 100A. Locking pins 107-1 are extended to lock lifting arm 100A during lifting and dumping, and retracted to release lifting arm 100A.

Although FIG. 9 shows container lids 40 with locking devices 42, the system shown in FIGS. 7 and 8 can be used in which lids 40 do not have a locking mechanism mounted on container 30. Thus, actuators 70A are operated prior to lifting to hold lids 40 closed. Actuators 70A are operated selectively during dumping as previously described.

As will now be recognized, a container and pickup arm assembly for use in an automated trash pickup system for recyclable materials has been disclosed. The container and pickup assembly has been shown in exemplary form; however, the invention is not to be limited to the specific arrangements as many variations may be made without departing from the spirit and scope of the invention. More or fewer bins may be provided, and in varying sizes and orientation. The lid closure systems may be changed to have closure devices associated with both pickup arms. Thus, the invention is to be limited only by the appended claims.

I claim:

1. Container and pickup apparatus for receiving separated recyclable material for subsequent selective dumping of said material comprising:

a) a container having a plurality of bins, each of said bins for receiving one type of said separated material and each of said bins having a hinged lid;

b) at least one channel attached to said container;

c) a pickup arm for engaging said container by fitting within said at least one channel;

d) means attached to said pickup arm for lifting and subsequent selective dumping of said materials from the container;

e) a lid closure means for each said bin movable between a first closed position to keep the associated hinged lid closed and a second position to allow the associated hinged lid to open; and f) a lid release means for each said lid closure means, each said lid release means being affixed to said pickup arm and independently operable from the other release means to move its associated lid closure means between its first and second positions.

2. The container and pickup apparatus as defined in claim 1 in which:

a) said at least one channel is attached to an exterior surface of said container; and b) said pickup arm includes a lifting arm having a forwardly extending arm for engaging said channel.

3. The container and pickup apparatus as defined in claim 2 in which:

a) said container includes a pair of channels, with one of said channels attached to each side of said container; and b) said pickup arm includes a pair of lifting arms each having a forwardly extending arm for engaging said pair of channels.

4. The container and pickup apparatus as defined in claim 1 in which:

a) said channel is a vertically oriented channel attached to one end of said container;

b) said pickup arm is a forwardly extending arm having a vertically directed forward end thereof.

5. The container and pickup apparatus as defined in claim 1 in which each said lid closure means includes a plurality of catches, each pivotally mounted to said container, said catches normally maintained in a closed position by biasing means; and each said release means includes an actuator adjacent each of said catches.

6. The container as defined in claim 1 which further includes a bin identification plate attached to an end of said container having a machine-readable code for each of said bins to permit said container to be selectively dumped.

7. The container and pickup apparatus as defined in claim 1 in which each said lid closure means is an actuator operated hold down device mounted to said pickup arm, each said hold down device being adjacent an associated lid, and wherein, after engagement of said pickup arm with said at least one channel, said hold down devices operate to contact and hold said lids in a closed condition.

* * * * *